US009182182B2

(12) United States Patent
Ning et al.

(10) Patent No.: US 9,182,182 B2
(45) Date of Patent: Nov. 10, 2015

(54) VARIABLE-FLOW NOZZLE FOR COOLING TOWER

(75) Inventors: Fangliang Ning, Shandong (CN); Hongxing Zhang, Jiangsu (CN); Shangchao Ning, Jiangsu (CN)

(73) Assignee: WUXI YONGXIN ENERGY TECHNOLOGY CO., LTD. (CN)

( * ) Notice: Subject to any disclaimer, the term of this patent is extended or adjusted under 35 U.S.C. 154(b) by 196 days.

(21) Appl. No.: 13/514,917

(22) PCT Filed: Dec. 8, 2010

(86) PCT No.: PCT/CN2010/079561

§ 371 (c)(1),
(2), (4) Date: Jun. 8, 2012

(87) PCT Pub. No.: WO2011/069449

PCT Pub. Date: Jun. 16, 2011

(65) Prior Publication Data

US 2012/0241541 A1 Sep. 27, 2012

(30) Foreign Application Priority Data

Dec. 8, 2009 (CN) ..... 2009 2 0284540 U

(51) Int. Cl.
*F28F 25/06* (2006.01)
*B05B 1/00* (2006.01)
*B05B 1/18* (2006.01)

(52) U.S. Cl.
CPC . *F28F 25/06* (2013.01); *B05B 1/00* (2013.01); *B05B 1/185* (2013.01)

(58) Field of Classification Search
USPC ..... 261/111
See application file for complete search history.

(56) References Cited

U.S. PATENT DOCUMENTS

| | | | | |
|---|---|---|---|---|
| 2,487,984 | A * | 11/1949 | Rodman | 422/143 |
| 4,390,478 | A * | 6/1983 | Sheperd | 261/6 |
| 5,064,537 | A * | 11/1991 | Chupka et al. | 210/497.01 |
| 5,839,662 | A * | 11/1998 | Leon et al. | 239/208 |

FOREIGN PATENT DOCUMENTS

| | | | |
|---|---|---|---|
| CN | 2143759 | 10/1993 | F28C 1/00 |
| CN | 2175391 | 8/1994 | F28C 1/00 |
| CN | 201170706 | 12/2008 | F28F 25/06 |
| CN | 201193937 | 2/2009 | F28F 25/06 |

(Continued)

OTHER PUBLICATIONS

International Search Report and Written Opinion issued for corresponding appln. No. PCT/CN2010/079561, dated Mar. 17, 2011 (17 pgs).

*Primary Examiner* — Len Tran
*Assistant Examiner* — Adam J Rogers
(74) *Attorney, Agent, or Firm* — Hayes Soloway P.C.

(57) ABSTRACT

A water spray nozzle (3) for cooling tower is provided. Wherein, the nozzle (3) or the upper connection section of the nozzle (3) has an upward extension section in a water distribution groove (1). Several layers of water inlet holes or slots (4) are opened around the extension section at different heights, or several tapered water inlets (5) with downward taper tips are distributed around the extension section. The nozzle (3) far from a water distribution port can still get the uniformly distributed water even when the water quantity of the cooling tower is low, the efficiency of the cooling tower thereby will not be reduced.

4 Claims, 2 Drawing Sheets

(56) References Cited

FOREIGN PATENT DOCUMENTS

| | | | | |
|---|---|---|---|---|
| CN | 201251398 | 6/2009 | ..... | F28F 25/06 |
| CN | 201607160 | 10/2010 | ..... | F28F 25/06 |
| GB | 290553 | 5/1928 | | |
| JP | 7234094 | 9/1995 | ..... | F28F 25/06 |

* cited by examiner

VARIABLE-FLOW NOZZLE FOR COOLING TOWER

FIELD OF THE INVENTION

The present invention relates to an improvement in nozzles for cooling towers, in particular to a self-adapting water spraying nozzle for cooling towers, which can regulate the water inflow automatically as water yield varies.

BACKGROUND OF THE INVENTION

An important prerequisite for the cooling effect of a cooling tower is even spraying of cooling water to the water spraying filler in the cooling tower. A water spraying approach in cooling tower is implemented with numerous non-pressure water spraying nozzles 3 with the same aperture 2, which are evenly distributed on the bottom of a water distribution channel 1 (as shown in FIG. 1); even water distribution from the nozzles is a prerequisite for even water spraying on the entire cross section and high water spraying efficiency. In the troughing distribution channel, the incoming water is distributed from the middle part towards the two ends of the channel, when the water inflow is relatively low (e.g., water inflow≤water spraying yield), the influent in the middle part will flow away through the spraying nozzles near the water inlet before it is distributed to the two ends of the channel; as a result, there will be no water or insufficient water at the two ends of the water distribution channel in the axial direction. The bigger the cooling tower structure is, the more severe the phenomenon will be. Consequently, the heat exchange area between chilled hot water and air will be reduced, and the heat exchange efficiency of the cooling tower will be degraded and lower than the design efficiency. In practice, a solution is to utilize sprinklers or sprinkler interfaces with different apertures according to the water inflow, so as to ensure even water distribution to the nozzles, however, that solution is troublesome, because the water inflow into the cooling tower varies frequently in practice, particularly in the cases that a plurality of cooling towers are used in combination and the nozzles are in a large quantity. Actually, it is impractical to replace the nozzles according to the water inflow.

Prior art target-type sprinklers have a flow regulation ring, which is used to achieve even water distribution at nozzles with different flow rates. See, for example, the split down-regulation target-type sprinkler disclosed in Chinese Patent CN2175391, which adds a nozzle or pipe joint with threaded connection between the deflector ring and the deflector of the existing target-type sprinkler; and the height-adjustable target-type sprinkler disclosed in Chinese Patent CN2143759, which adds a flow regulator on the existing target-type sprinkler by threaded connection in the flow regulation ring, and in which the flow regulator comprises a deflector ring with a male thread cylindrical body and a louver-form structure on the top, and grid shaped openings on the sides. A main object of the above-mentioned inventions is to keep a constant water inflow level for the nozzles against severe floor level differences and thereby ensure even water distribution in the towers. However, such solutions can't deal with dynamic variations of the water field, because they can't ensure even water distribution at different water inflow rates automatically, and it is impractical to carry out manual regulation frequently in engineering applications. Moreover, such structures will cause increased manufacturing cost of the nozzles.

DISCLOSURE OF THE INVENTION

Technical Problem

Since prior art water spraying nozzles for cooling towers can't ensure automatic and even water distribution to the spraying nozzles as the water inflow into the water distribution channel varies, the drawback that water sprays unevenly has existed for a long time and has not been settled yet; the variation range of water flow rate in cooling towers specified in current technical standards is small, and can't meet the demand for application of variable flow-rate techniques in modern central air conditioning systems. Improvement must be made against the drawback.

The object of the present invention is to overcome the above-mentioned drawback of the prior art, and to provide a water spraying nozzle for cooling tower, which can achieve even water distribution automatically as the water field varies, without nozzle replacement or manual regulation.

Technical Solution

To attain the above-mentioned object, the water spraying nozzle for cooling tower provided in the present invention comprises a nozzle or an upper connection section of a nozzle, wherein, the nozzle or the upper connection section of the nozzle has an upward extension section in the water distribution channel, which has several layers of water inflow holes or slots on its periphery at different elevations, or has several inverted conical water inflow slots distributed on its periphery. Preferably, on the upward extension section in the water distribution channel, the water inflow structures on the periphery are inverted conical water inflow slots, to achieve better self-adapting water distribution effect against variations of water inflow.

The upward extension section can be made with the nozzle or the upper connection section of nozzle into an integral assembly, or assembled in a removable manner, such as a threaded connection or a plug-in connection. Preferably, in the present invention, the extension section is connected to the nozzle or upper connection section of the nozzle by a plug-in connection, which is favorable for renovation of existing cooling towers and the water spraying nozzles.

The water spraying nozzles described in the present invention can be any nozzles in the prior art. There is no special restriction here for the nozzles.

Beneficial Effects

Comparing the water spraying nozzles in the prior art, since an upward extension section is added to the upper part of the water distribution channel in the present invention and multi-layer water inflow openings are arranged on the periphery of the extension section or inverted conical water inflow slots are arranged on the periphery of the extension section, the water spraying nozzle can regulate the water inflow in a self-adapting manner according to water inflow, and thereby even water distribution to the nozzles away from the water inlet can still be ensured when the water flow is low, even water spraying on the entire cross section of the water distribution channel can be achieved, and cooling efficiency of the cooling tower will not be degraded; in addition, the variable range of water flow in the cooling tower can be widened, and variable flow-rate cooling towers can be implemented. Therefore, the nozzle provided in the present invention is particularly suitable for variable flow-rate cooling water systems for central air conditioning systems.

Specifically, an upward extension section is added to the existing water spraying nozzle or nozzle adapter in the water distribution channel, and the extension section has several rows of water inflow holes on its periphery at different elevations or has inverted conical water inflow slots on its periphery. Thus, as water flow varies, the water flow into the nozzles will vary with the water level fluctuation in the water distribution channel synchronously, and therefore the water distribution will remain essentially in the same state as the original state, which is to say, when the water flow is high, the water flow into the nozzles will be high; when the water flow is low, the water flow into the nozzles (especially nozzles near the water inlet) will be low; consequently, even water distribution to the nozzles will still be achieved when the water flow is low. In the prior art, no matter how much the water flow is, the water flows into the nozzles which are nearest the water inlet, so that when the water flow rate is low, there may be no water flow left for the nozzles which are far away from the water inlet. As a result, water spraying will not be even, and the cooling efficiency will be degraded. In that way, the above-mentioned drawback in the prior art is overcome, and the object of the present invention is attained.

DETAILED DESCRIPTION OF THE EMBODIMENTS

The present invention will be detailed and illustrated in two preferred embodiments. However, the details of the embodiments are only described to interpret the present invention, do not represent the entire technical solution of the present invention. Therefore, the embodiments shall not be deemed as any limitation to the technical solution of the present invention. The person skilled in the art shall appreciate that any insubstantial modification and/or alternation to the embodiments without departing from the spirit of the present invention (e.g., modify or alter the embodiments simply with technical features that have identical or similar technical effects) shall be embraced within the protection scope of the present invention.

Embodiment 1

Figure 1:
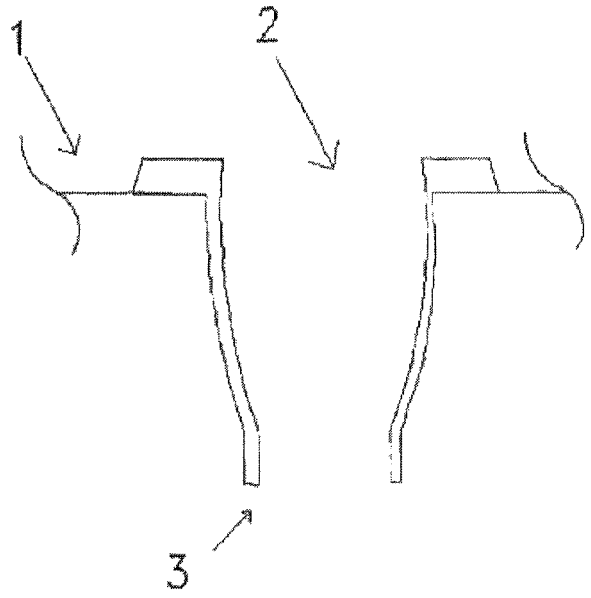
FIG. 1 PRIOR ART
FIG. 1 is a structural schematic diagram of the upper part of a nozzle in the prior art.
Figure 2:
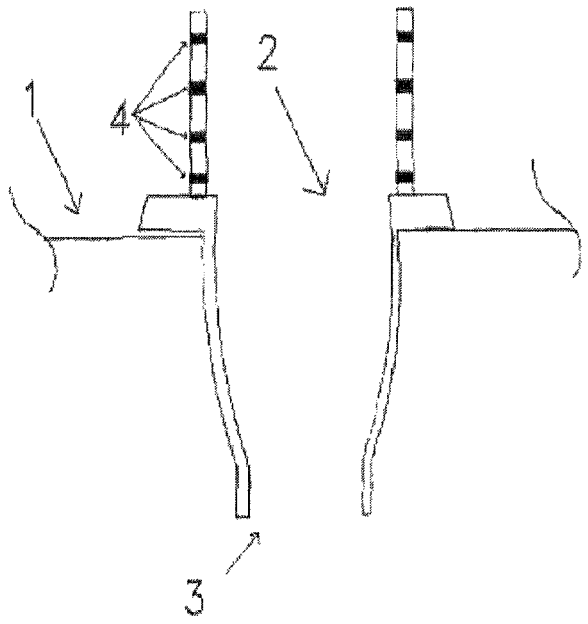
FIG. 2 is a structural schematic diagram of the first embodiment in the present invention.

As shown in FIG. 2, the water spraying nozzle 3 for cooling tower in the present invention has an upward extension pipe section 6 (extension pipe section of water inflow pipe 2) with sealed plug-in connection in a water distribution channel 1, and the extension pipe section has multi-layer water inflow holes or vertical slots 4 arranged on the periphery thereof at different elevations.

Embodiment 2

Figure 3:
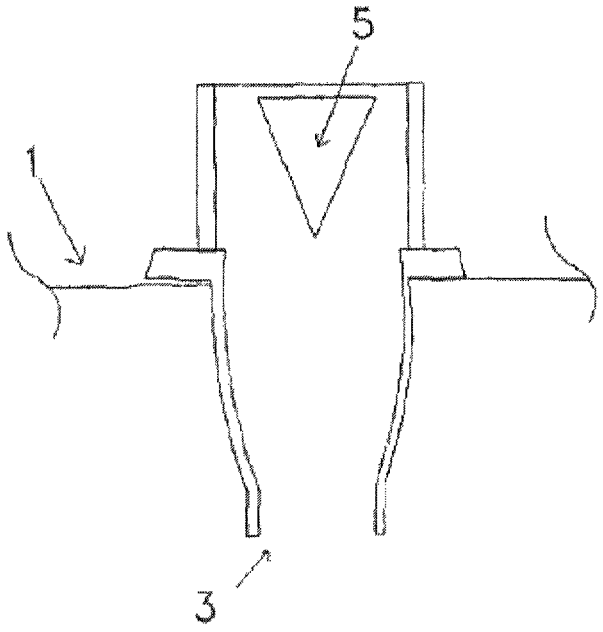
FIG. 3 is a structural schematic diagram of the second embodiment in the present invention.

As shown in FIG. 3, similar to embodiment 1, the extension pipe section has several vertical inverted conical water inflow slots 5 evenly distributed on its periphery.

The water spraying nozzle for a cooling tower described in the present invention comprises a nozzle body and/or an upper connection section of nozzle, depending on the structure of the water spraying nozzles.

The person skilled in the art can directly derive or envisage some variants from the disclosure in the present invention and common knowledge, inspired by the ideal and embodiments of the present invention; the person having ordinary skills in the art can also realize that some functions and effects essentially identical to those disclosed in the embodiments, can be implemented with other methods or by means of replacement with well-known techniques in the prior art and different combinations of features, for example, some insubstantial modifications can be made, e.g., the nozzle comprises a nozzle body and a connection pipe section, the connection pipe section of nozzle can be manufactured to include an upward extension section, which connects to the nozzle or the connection pipe section by threaded connection or be made into an integral assembly, etc. However, all such variations, modifications, replacements, and alternations can achieve the substantially same function and effect to that of the above-mentioned embodiments and shall be deemed as falling into the protection scope of the present invention.

The invention claimed is:

1. A water spraying nozzle for a cooling tower, comprising a nozzle or an upper connection section of a nozzle, wherein, the nozzle or upper connection section of the nozzle has an upward solid wall extension section for extending into a water distribution channel, the extension section having a plurality of water inflow holes in the form of inverted conical water inflow holes, evenly distributed on an external periphery of the extension section, in which the holes are oriented with their respective apexes at the lowest point, on a periphery of the extension section, whereupon to achieve self-adapting water distribution effect against variations of water inflow.

2. The water spraying nozzle for cooling tower according to claim 1, wherein, the upward extension section is connected to the nozzle or the upper connection section of nozzle by plug-in connection.

3. The water spraying nozzle of claim 1, wherein in the nozzle and the upper connection section comprises an integral assembly.

4. The water spraying nozzle of claim 1, wherein the nozzle and the upper connection section are assembled by a threaded or a plug-in connection.

* * * * *